US008602671B2

(12) United States Patent
Kim

(10) Patent No.: US 8,602,671 B2
(45) Date of Patent: Dec. 10, 2013

(54) COSMETICS CONTAINER WITH A PUFF ROTATABLY MOUNTED ON A CONTAINER BODY

(76) Inventor: Sam Kim, Anyang-si (KR)

( * ) Notice: Subject to any disclaimer, the term of this patent is extended or adjusted under 35 U.S.C. 154(b) by 550 days.

(21) Appl. No.: 12/937,678

(22) PCT Filed: Apr. 14, 2008

(86) PCT No.: PCT/KR2008/002103

§ 371 (c)(1),
(2), (4) Date: Oct. 13, 2010

(87) PCT Pub. No.: WO2009/128571

PCT Pub. Date: Oct. 22, 2009

(65) Prior Publication Data

US 2011/0033223 A1 Feb. 10, 2011

(51) Int. Cl.
*B43M 11/02* (2006.01)

(52) U.S. Cl.
USPC ..... 401/219; 401/208

(58) Field of Classification Search
USPC ..... 401/208, 218–220, 197, 137–139
See application file for complete search history.

(56) References Cited

U.S. PATENT DOCUMENTS

| | | | | | |
|---|---|---|---|---|---|
| 3,609,051 | A | * | 9/1971 | Braun | 401/197 |
| 4,648,732 | A | * | 3/1987 | Smialkowski | 401/196 |
| 4,747,720 | A | * | 5/1988 | Bellehumeur et al. | 401/205 |
| 5,769,769 | A | * | 6/1998 | Torntore | 492/13 |

FOREIGN PATENT DOCUMENTS

| | | |
|---|---|---|
| JP | S63-37118 | 3/1988 |
| JP | H3-38008 | 4/1991 |
| KR | 20-0362401 | 9/2004 |
| KR | 10-2008-0024942 A | 3/2008 |

* cited by examiner

*Primary Examiner* — David Walczak

(57) ABSTRACT

A cosmetics container has a puff rotatably mounted on a container body. The cosmetics container of the present invention has a container body for containing liquid cosmetics and having a discharge port for discharging the cosmetics outside, a supporting member mounted rotatably on an outside of the container body and a puff assembled on an outside of the supporting member and rotating together with the supporting member. With the cosmetics container, dressing cosmetics is convenient and the user can dress the cosmetics uniformly.

6 Claims, 5 Drawing Sheets

COSMETICS CONTAINER WITH A PUFF ROTATABLY MOUNTED ON A CONTAINER BODY

CROSS-REFERENCE TO RELATED APPLICATION

This application is a U.S. National Phase Application of PCT International Application PCT/KR2008/002103, filed Apr. 14, 2008, the contents of which are incorporated herein by reference in their entirety.

TECHNICAL FIELD

The present invention relates to a cosmetics container, and more particularly, to a cosmetics container for containing liquid cosmetics and having a puff for dressing the cosmetics on a skin.

BACKGROUND ART

A cosmetics user dresses the cosmetics on his/her skin by using a tool such as a puff after spreading the cosmetics on the skin by dipping a hand into the cosmetics or pressing the cosmetics container. The puff is generally made of a material like sponge, etc., and the puff is prepared as a separate part between the container body and a cap so that the user can use by grasping the puff whenever necessary. As the user has to use the cosmetics container by grasping the puff whenever he/she uses, for instance, in case of fixing a makeup outdoors, the user feels inconvenience.

On the other hand, there is the cosmetics container equipping with the puff fixed on the cosmetics container itself or another part, where the puff is not a separate member. The user dresses the cosmetics on the skin by grasping the puff fixed on the cosmetics container or another part after spreading the cosmetics on the skin. However, such a cosmetics container cannot dress the cosmetics on the skin uniformly despite using the puff.

DISCLOSURE OF INVENTION

Technical Problem

The present invention has been proposed to solve the above problem, and it is the object of the present invention to provide a cosmetics container that the convenience of the use is achieved as the puff is not prepared as a separate member, and the user can evenly dress the cosmetics when using the puff.

Technical Solution

To solve the above problem, the present invention provides a cosmetics container comprising: a container body for containing liquid cosmetics, the container body having a discharge port for discharging the cosmetics outside; a supporting member being mounted rotatably on an area of an outside of the container body; and a puff being assembled on an outside of the supporting member, the puff being capable of rotating together with the supporting member.

The end of the supporting member is open so that the cosmetics discharged through the discharge port of the container body can be discharged outside and an outside cap installed on the container body so as to cover the supporting member and the puff, the outside cap being formed with an opening/closing protrusion on an inner side thereof, the outside cap for preventing discharge of the cosmetics.

The supporting member is formed with a protrusion part in order to prevent a separation of the puff.

The supporting member and the puff are integrally formed and for instance, the puff is formed by spreading nylon or fiber on the supporting member.

An opening/closing member that opens the discharge port in order to discharge the cosmetics in the container body is installed as the container body is pressed.

Advantageous Effects

According to the present invention, the cosmetics container is provided that dressing the cosmetics is very convenient and the user can dress the cosmetics uniformly.

BEST MODE FOR CARRYING OUT THE INVENTION

Hereinbelow, the present invention will be described in greater detail with reference to the accompanying drawings.

Figure 1:
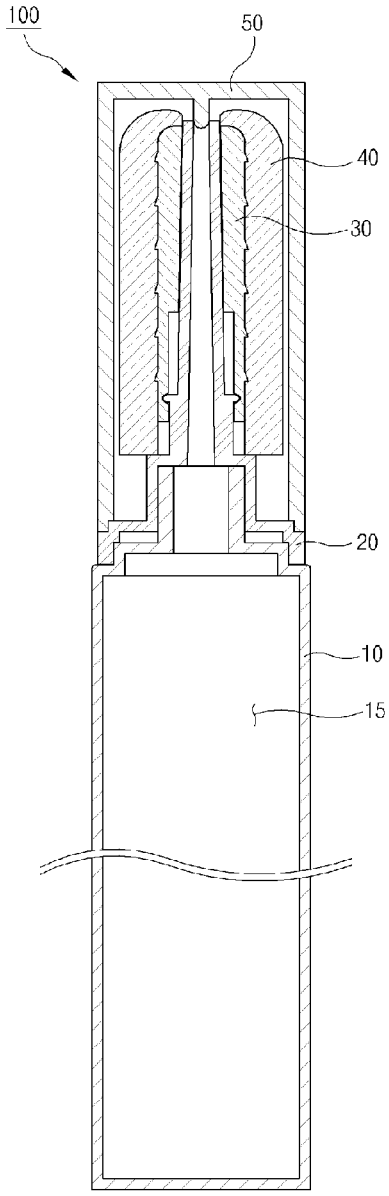
FIG. 1 is a side sectional view of the cosmetics container according to the present invention.

FIG. 1 is a side sectional view of the cosmetics container according to the present invention, and FIGS. 2 to 7 are side sectional views respectively showing each part in FIG. 1.

As shown in FIG. 1, the cosmetics container 100 according to the present invention is comprised of a container body 10, a nozzle cap 20, a supporting member 30, a puff 40 and an outside cap 50.

Figure 2:
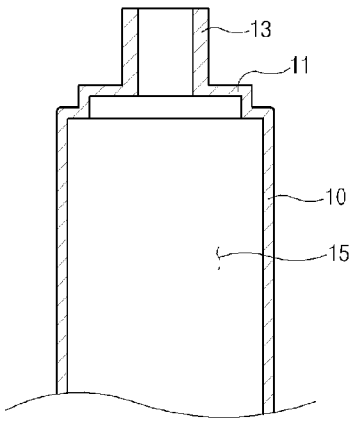
FIG. 2 is a partial view of the cosmetics container of FIG. 1.

As shown in FIGS. 1 and 2, a containing space 15 for containing the cosmetics contents is formed on an inside of the container body 10. A shoulder 11 corresponding to a lower part of the nozzle cap 20 is formed on an upper side of the container body 10 in order to assemble with the nozzle cap 20. And a discharge port 13 is formed on an upper side of the shoulder 11 so as to discharge the cosmetics outside. It is preferable that the container body 10 is made of flexible material and according to this, the cosmetics contained in the containing space 15 is discharged through the discharge port 13 upward as a user presses the container body 10 with his/her hand.

Figure 3:
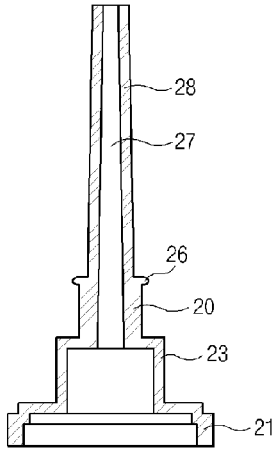
FIG. 3 is a side sectional view of the discharging member of FIG. 1.

As shown in FIGS. 1 and 3, the nozzle cap 20 equips a sleeve 21 and an assembly portion 23 corresponding to the upper shape of the container body 10 so that the lower side thereof is assembled with the upper part of the container body 10. The nozzle cap 20 is fixed on the upper side of the container body 10 by assembling the sleeve 21 and the assembly portion 23 with the shoulder 11 and the discharge port 13 on the upper side of the container body 10. The upper side of the nozzle cap 20 equips a nozzle portion 28 extended upward, and a discharge path 27 is formed in the nozzle portion 28. The cosmetics discharged through the discharge port 13 of the container body 10 is then discharged upward through the discharge path 27 of the nozzle portion 28. Meanwhile, a protrusion rib 26 of a stripe shape is formed on a middle portion of the nozzle cap 20.

Figure 4:
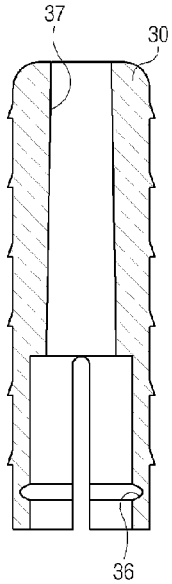
FIGS. 4 and 5 are a side sectional view and a side view of the supporting member of FIG. 1.
Figure 5:
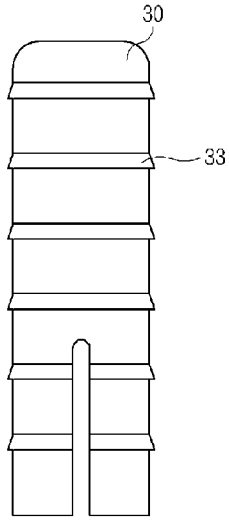

As shown in FIGS. 1, 4 and 5, the supporting member 30 is a member having a sectional shape of a pipe, and the supporting member 30 is assembled with the nozzle cap 20 by insertion so as to adjoin the nozzle portion 28 of the nozzle cap 20. In such a situation, the inside diameter of the inside of the supporting member 30 is formed to be somewhat greater than the external diameter of the nozzle portion 28 of the nozzle cap 20. According to this, the supporting member 30 is not fixedly assembled with the nozzle portion 28, and the supporting member 30 can be mounted rotatably on the nozzle portion 28 when the supporting member 30 is assembled with the nozzle portion 28 by insertion. Furthermore, the end of the supporting member 30 is open so that the cosmetics can be discharged through the end of the supporting member 30.

A groove 36 of a ring shape is formed on a lower part of the inside 37 of the supporting member 30. The groove 36 is assembled with the protrusion rib 26 of the nozzle portion 28 while the supporting member 30 is assembled on the nozzle portion 28. According to this, as stated above, while the supporting member 30 can be rotated around on the nozzle portion 28, the supporting member 30 is not separated upward of the nozzle portion 28.

Many protrusion portions 33 are formed on the outside of the supporting member 30. As shown in FIG. 5, the protrusion portion 33 can be formed to a ring shape or a protrusion shape. The supporting member 30 is assembled with the puff 40 solidly by the protrusion portions 33.

Figure 6:
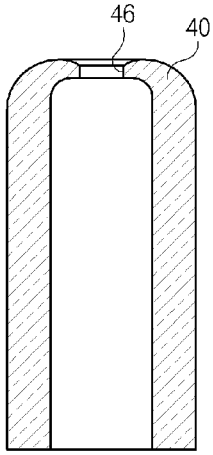
FIG. 6 is a side sectional view of the puff of FIG. 1.

As shown in FIGS. 1 and 6, the puff 40 is formed to a pipe shape in order to be assembled on the outside of the supporting member 30 by insertion. A small size discharge hole 46 is equipped on an upper side of the puff 40. The cosmetics discharged through the nozzle portion 28 of the nozzle cap 20 is discharged outside through the discharge hole 46 of the puff 40. The puff 40 is assembled with the supporting member 30 so as to cover the outside of the supporting member 30 with the inside thereof. At this moment, the puff 40 is assembled with the supporting member 30 solidly as it is assembled by pressure by the protrusion portions 33 of the supporting member 30. Accordingly, the supporting member 30 is rotated together with the puff 40. And the puff 40 is not separated upward of the supporting member 30 by the protrusion portions 33.

Like this, the puff 40 is rotatably mounted on the upper side of the container body 10. In such a situation, the rotation of the puff 40 is guaranteed by rotatable assembly between the supporting member 30 and the nozzle cap 20.

The puff 40 can be made of a material like sponge, NBR and SBR or the like. For instance, the puff can be made not by insertion but by assembly with the supporting member 30 by spreading nylon or fiber on the outside of the supporting member 30 after spreading an adhesive on the outside of the supporting member 30. Furthermore, the supporting member 30 and the puff 40 are integrally formed in a body in substance in case of making the puff 40 in this manner. And the supporting member 30 can be integrally formed with the puff 40 according to a selection of the material. In case of this, although it looks like omitting one of the supporting member 30 and the puff 40 in substance, the function that it is mounted rotatably on the container body 10 is maintained. The term "integrally" in the following claims of the present description is used as a notion including several examples as the above.

Figure 7:
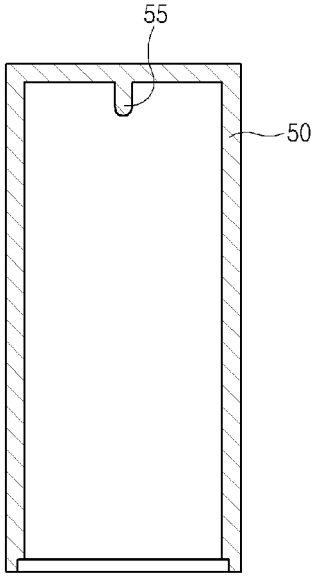
FIG. 7 is a side sectional view of the cap of FIG. 1.

As shown in FIGS. 1 and 7, the outside cap 50 constitutes a lid covering the upper side of the container body 10. An opening/closing protrusion 55 is equipped on an upper side of an inner side of the outside cap 50. As shown in FIG. 1, the opening/closing protrusion 55 closes the upper end of a discharge path 27 of the nozzle portion 28 while the outside cap 50 is mounted on the container body 10. Accordingly, the cosmetics contained in the containing space 15 in the container body 10 is not discharged outside even when the user presses the container body 10 while the outside cap 50 is assembled with the container body 10.

Such a cosmetics container 100 is used as follows:

First, the cosmetics user grasps the cosmetics container 100 and separates the outside cap 50. And then, the cosmetics in the container body 10 is discharged outside through the discharge port 13 and the discharge path 27 and the discharge hole 46 as the user presses the container body 10 by his/her hand, etc. The discharged cosmetics is spread on the user' skin.

And then, the user dresses the cosmetics on the skin while contacting the puff 40 on the skin. In this situation, if the puff 40 is used while a side of the puff 40 is in contact with the skin, the cosmetics is dressed on the skin while the puff 40 is being rotated on the skin. Accordingly, the cosmetics is dressed on the skin while the puff is being rotated on the skin as a roller paints a wall while rotating when the roller is in contact with the wall. Accordingly, as the cosmetics is spread on the skin uniformly and a rubbing between the user' skin and the puff 40 is rare, the damage on the skin can be prevented.

As the user can spread the cosmetics on the skin and dress the cosmetics on the skin while the user holds the cosmetics container 100 after separating only the outside cap 50, the convenience of the use is given and the cosmetics does not stain the user' hands. Therefore, in case of fixing a makeup outdoors, the user feels convenience.

Furthermore, for instance, if the puff 40 is worn by a long use or is damaged by carelessness, the assembled supporting member 30 and puff 40 can be replaced with a new one by separating the supporting member 30, or only the puff 40 on the supporting member 30 can be replaced with a new one, so the reuse can be easy.

The user assembles the outside cap 50 into the container body 10 after using. According to this, the cosmetics is not discharged outside despite pressing the container body 10. Therefore, the unintended discharge of the cosmetics is prevented.

Figure 8:
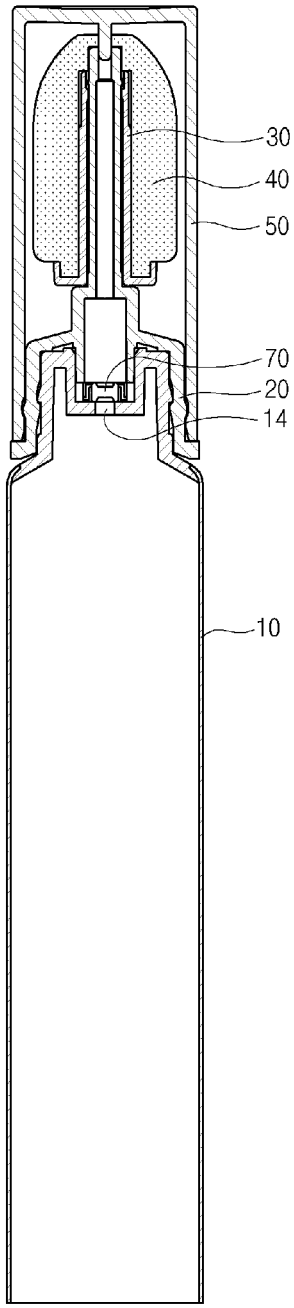
FIG. 8 is a side sectional view of the cosmetics container according to another embodiment of the present invention.
Figure 9:
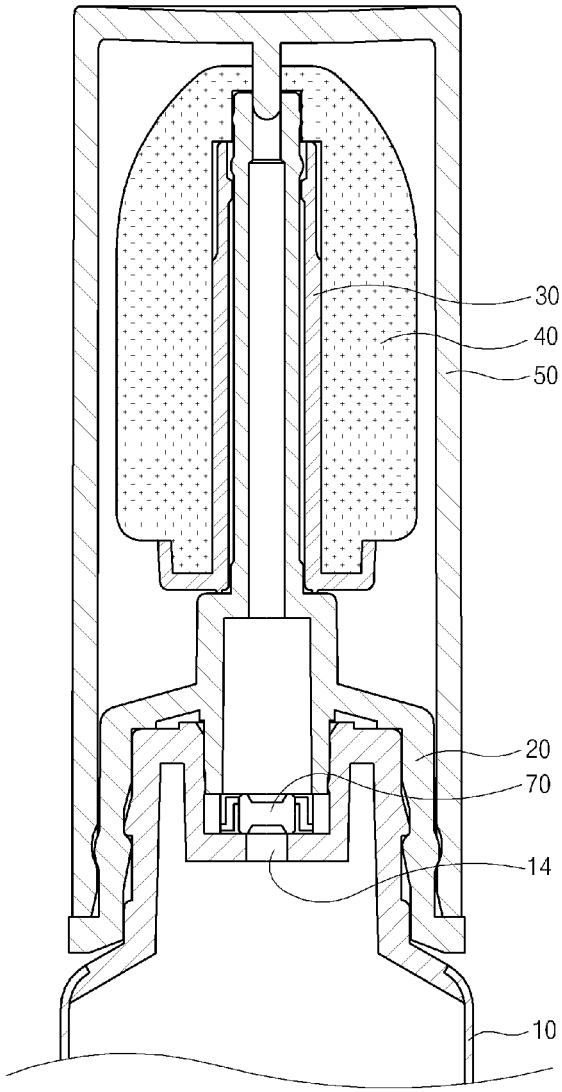
FIG. 9 is an enlarged view of an upper part of FIG. 8.

FIG. 8 is a side sectional view of the cosmetics container according to another embodiment of the present invention, and FIG. 9 is an enlarged view of an upper part of FIG. 8. In the present embodiment, although the shape of each part is somewhat different in comparison with the above stated embodiment, most construction is the same in comparison with the above stated embodiment. Accordingly, parts similar to those in the above stated embodiment described with reference to FIGS. 1 to 7 are referred to with the same reference numerals.

In the present embodiment, an opening/closing member 70 is formed on the discharge port 14 of the container body 10. This is different in comparison with the above stated embodiment and the other parts are the same in substance.

The discharge port 14 is opened by the opening/closing member 70 when the cosmetics in the container body 10 is discharged as the container body 10 is pressed. Accordingly, as the discharge port 14 is not open when the container body 10 is not pressed, the cosmetics do not leak by itself in ordinary condition. The structure of a general one-way valve can be employed as the structure of the opening/closing member 70.

The preferred embodiments have been illustrated and described so far, however, it will be understood by those skilled in the art that various changes and modifications can be made within the spirit and the scope of the present invention, and accordingly, the scope of the present invention is not limited within the described range but the following claims and the equivalents thereof.

The invention claimed is:

1. Cosmetics container comprising;

a container body for containing liquid cosmetics, the container body having a discharge port for discharging the cosmetics outside;

a supporting member being mounted rotatably on an area of an outside of the container body, wherein the end of the supporting member is open so that the cosmetics discharged through the discharge port of the container body can be discharged outside;

a puff being assembled on an outside of the supporting member, the puff being capable of rotating together with the supporting member; and an outside cap installed on the container body so as to cover the supporting member and the puff, the outside cap being formed with an opening/closing protrusion on an inner side thereof, the outside cap for preventing discharge of the cosmetics.

2. The cosmetics container as claimed in claim 1, wherein the supporting member and the puff are integrally formed.

3. The cosmetics container as claimed in claim 2, wherein the puff is formed by spreading nylon or fiber on the supporting member.

4. The cosmetics container as claimed in claim 1, wherein the supporting member is formed with a protrusion part in order to prevent a separation of the puff.

5. The cosmetics container as claimed in claim 1, further comprising an opening/closing means for opening/closing the discharge port of the container body.

6. The cosmetics container as claimed in claim 5, wherein the opening/closing means comprises an opening/closing member that opens the discharge port in order to discharge the cosmetics in the container body as the container body is pressed.

* * * * *